United States Patent [19]

Counsel et al.

[11] Patent Number: 5,006,081

[45] Date of Patent: Apr. 9, 1991

[54] ELECTRICAL WIRE CONNECTOR

[75] Inventors: Eugene F. Counsel, Clearwater, Fla.; Walter M. Werner, Downingtown, Pa.

[73] Assignee: AMP Incorporated, Harrisburg, Pa.

[21] Appl. No.: 567,228

[22] Filed: Aug. 14, 1990

[51] Int. Cl.[5] ..... H01R 4/50

[52] U.S. Cl. ..... 439/783

[58] Field of Search ..... 439/783, 863

[56] References Cited

U.S. PATENT DOCUMENTS

| | | | |
|---|---|---|---|
| 3,045,205 | 7/1962 | Osborn | 439/783 |
| 3,065,449 | 11/1962 | Matthyssee et al. | 439/783 |
| 3,065,452 | 11/1962 | Osborn | 439/783 |
| 4,533,205 | 8/1985 | Frank | 439/783 |
| 4,650,273 | 3/1987 | Roosdrop | 439/783 |
| 4,723,920 | 2/1988 | Werner | 439/783 |
| 4,915,653 | 4/1990 | Main | 439/783 |

*Primary Examiner*—Paula A. Bradley

*Attorney, Agent, or Firm*—Allan B. Osborne

[57] ABSTRACT

An electrical wire connector (10) of the wedge type for commoning a pair of electrical wires (66,68) together is disclosed. More particularly, the C-member (12) has a hole (46) to receive a dimple (60) or pin (96) on the wedge to lock the two components together.

3 Claims, 3 Drawing Sheets

ELECTRICAL WIRE CONNECTOR

FIELD OF THE INVENTION

This invention relates to wedge connectors for electrically commoning and mechanically securing two electrical wires.

BACKGROUND OF THE INVENTION

Electrical connectors of the type having a C-shaped body member having converging channels and a complementary wedge member have been known from at least as early as Apr. 21, 1931 when U.S. Pat. No. 1,801,277 issued to W. G. Kelley on an application filed May 18, 1926. Subsequent thereto a large number of patents disclosing different and improved embodiments have issued, including more recently U.S. Pat. Nos. 4,415,222 and 4,600,264. In each of the disclosures, the basic Kelley concept was followed; i.e., two conductors are electrically and mechanically connected by being pressed into and against interior curved surfaces or channels provided in a C-shaped body member by a wedge being driven longitudinally into the body member between the conductors.

These known wedge connectors have been very successfully used in the power utility industry for a number of years for large diameter cable where the C-members are massive enough to exert a resilient, compressive force against the cables trapped in the channels by the wedge. It is now proposed to provide a wedge connector for smaller diameter wire.

SUMMARY OF THE INVENTION

According to the present invention, an electrical connector for joining a pair of wires together is provided with the connector having a wedge-shaped C-member with channels along each edge joined by a web, a wedge for being pressed in between wires placed in the channels and a locking device for locking the C-member and wedge together.

DESCRIPTION OF THE INVENTION

Figures 1, 2, 3:
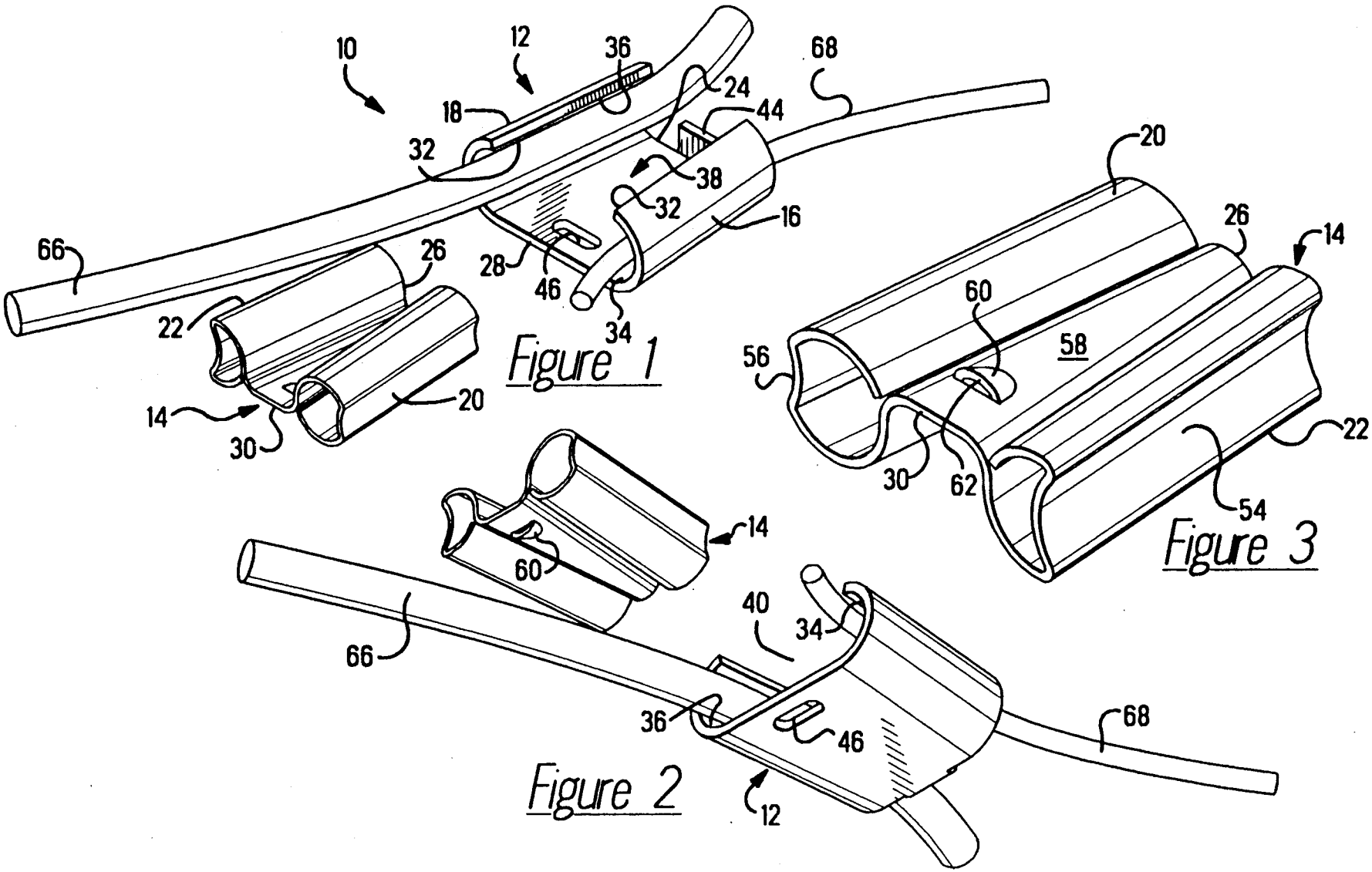
FIGS. 1 and 2 are perspective views of the two components of one embodiment of the connector of the present invention.
FIG. 3 is a perspective view of the wedge of the connector of FIGS. 1 and 2.

As shown in FIGS. 1 and 2, connector 10 includes C-member 12 and wedge 14. Both components 12,14 have a wedge shape; i.e., the sides 16,18 of C-member 12 and tubular edge members 20,22 of wedge 14 converge towards ends 24,26 respectively from ends 28,30 respectively.

Edges 32 of C-member 12 have been rolled in to form channels 34,36 which face each other and are joined by web 38 extending therebetween. Channels 34,36 and web 38 define space 40 therebetween. In the embodiment illustrated, channels 34,36 are of equal size but could be of unequal size.

Tab 44 extends outwardly from web 38 at end 24 and hole 46 extends through web 38 adjacent end 28.

C-member 12 may be stamped and formed from a suitable metal such as brass.

With reference to FIG. 3, wedge 14 includes the aforementioned pair of tubular edge members 20,22 with each having outwardly facing concave surfaces 54,56 respectively and a web 58 extending between and joining edge members 20,22. An arcuate shaped dimple 60 is blanked out of web 58 to provide shoulder 62 facing wedge end 30.

Wedge 14 as shown is stamped and formed from sheet metal such as brass.

Surface 54 on edge member 22 has been formed to have a large width to accommodate the larger diameter wire 66 and surface 56 has been formed with a smaller width to accommodate smaller diameter wire 68. Typically wire 66 is six gauge and wire 68 is twelve gauge.

As is well known in the industry, wires 66,68 are secured in channels 32,34 by driving wedge 14 into C-member 12 between the wires 66,68. Whereas larger size wedge connectors require specific industrial tools to drive the wedge in, connector 10 can be assembled by pressing wedge 14 in with a pair of channel lock pliers.

As wedge 14 is being pressed into space 40, sides 16,18 of member 12 are resiliently forced outwardly to provide a continuing compressive force on wires 66,68. Overtravel of wedge 14 is prevented by tab 44.

The user knows wedge 14 has reached the correct insertion depth when dimple 60 enters hole 46. Further, wedge 14 cannot back out of C-member 12 because of shoulder 62 engaging the edge of hole 46.

Web 58 of wedge 14 bends slightly as dimple 60 slides over web 38 of C-member 12 and rebounds to drive dimple 60 into hole 46 sharply.

Figure 4:
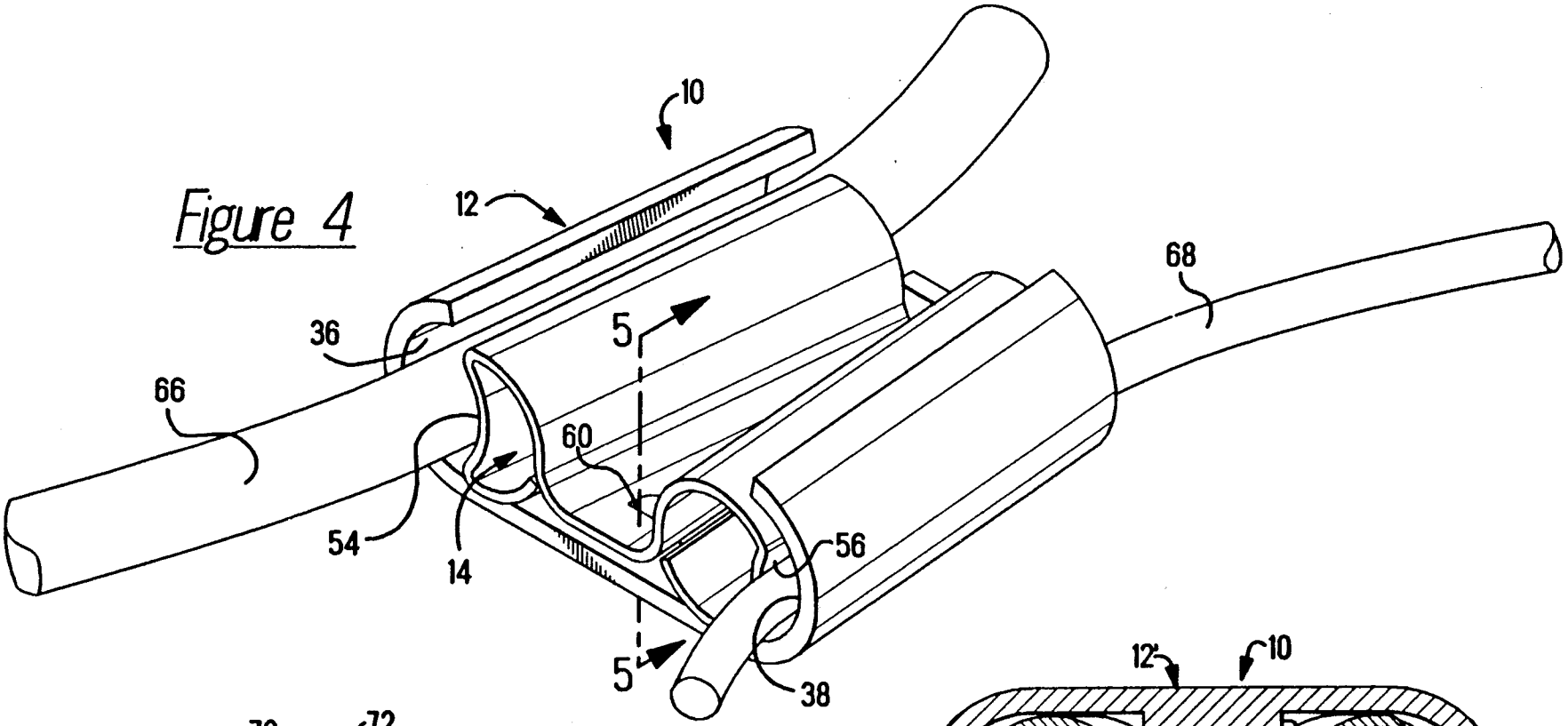
FIG. 4 is a perspective view of the connector with a pair of wires secured therein.
Figure 5:
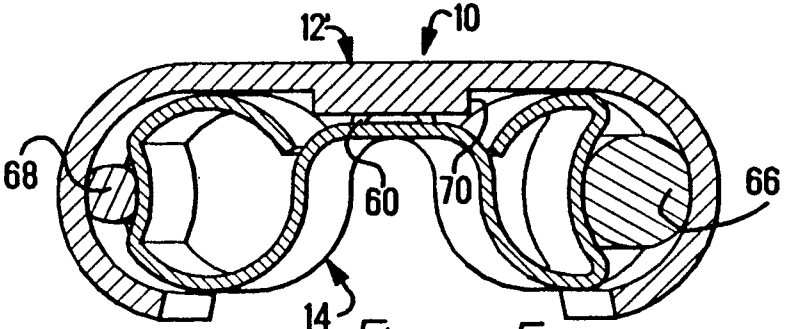
FIG. 5 is a sectioned view across the connector of FIG. 4.

FIGS. 4 and 5 are views showing an assembled connector 10.

Figure 5A:
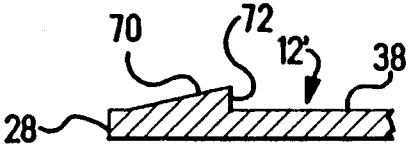

Further, FIGS. 5 and 5A show a C-member 12' which differs from member 12 in that hole 46 has been replaced with an inclined locking tab 70 which functions in the same manner as hole 46; i.e., the forwardly facing shoulder 72 on tab 70 engages shoulder 62 on dimple 60 to prevent wedge 14 from backing out.

Wedge 14 may be removed by prying dimple 60 out of its locking engagement with either hole 46 or tab 70.

Wedge 14 has been illustrated as being made from sheet metal. Alternatively, wedge 14 may by made as a solid piece such as wedge 80 shown in FIGS. 6 and 7.

Figures 6, 7:
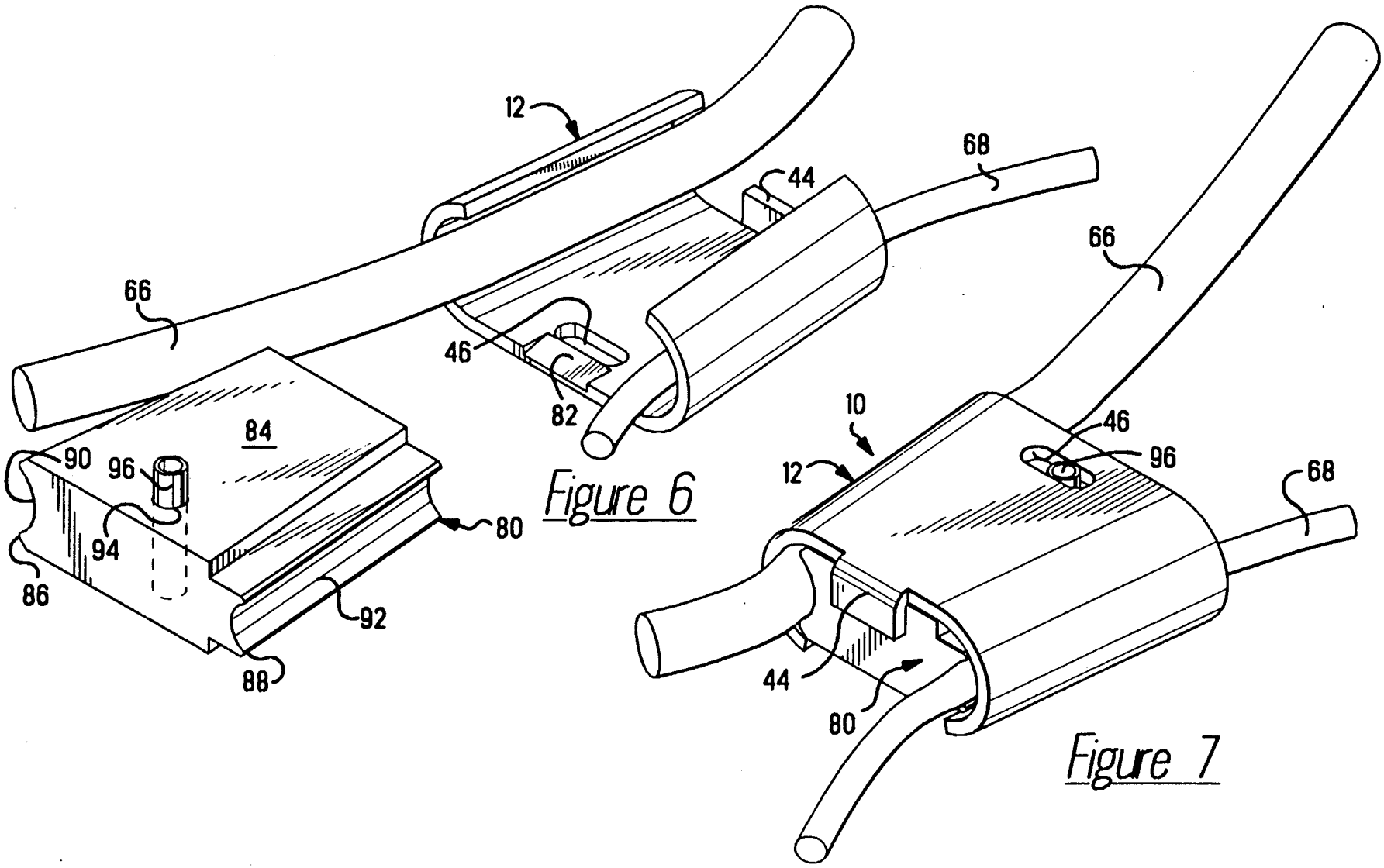
FIG. 6 is a perspective view of the two components of another embodiment of the connector of the present invention.
FIG. 7 is a perspective view of the connector of FIG. 6 with a pair of wires secured therein.

With reference to FIGS. 6 and 7, C-member 12 is as described above but showing a ramp 82 leading to hole 46 for use with wedge 14.

Wedge 80 includes body member 84 having converging sides 86,88. Outwardly facing surfaces 90,92 are concave to conformably receive wires 66,68. In this respect, surface 90 has a large width to receive wire 66 and surface 92 a smaller width to receive wire 68. Further, the thickness of body member 84 is reduced somewhat leading to surface 92.

Additionally body member 84 is provided with hole 94 and roll pin 96.

Wedge 80 is locked into C-member 12, as shown in FIG. 7, by pushing roll pin 96 into hole 46.

As can be discerned, an electrical wire connector of the wedge type has been disclosed. The C-member and wedge have cooperating structure for holding the two components together to prevent the wedge from inadvertently backing out of the C-member.

We claim:

1. An electrical wire connector for electrically commoning and mechanically securing a pair of electrical wires, comprising:

a C-member having converging sides towards one end and rolled over edges defining a pair of inwardly facing channels along respective sides and a web attached to and extending between said channels, and further having a hole through said web intermediate said channels; and a wedge having converging sides towards one end to be conformably received in said C-member, said wedge having concave, outwardly facing surfaces on each side and an outwardly extending dimple intermediate said sides, said dimple adapted to enter said hole when said wedge is pressed into said C-member to secure said wedge from inadvertently backing out of said C-member.

2. An electrical wire connector for electrically commoning and mechanically securing a pair of electrical wires, comprising:

a C-member having converging sides towards one end and rolled over edges defining a pair of inwardly facing channels along respective sides and a web attached to and extending between said channels and further having an inclined locking tab on said web intermediate said channels; and a wedge having converging sides towards one end to be conformably received in said C-member, said wedge having concave, outwardly facing surfaces on each side and an outwardly extending dimple intermediate said sides, said dimple adapted to engage said locking tab when said wedge is pressed into said C-member to secure said wedge from inadvertently backing out of said C-member.

3. An electrical wire connector for electrically commoning and mechanically securing a pair of electrical wire, comprising:

a C-member having converging sides towards one end and rolled over edged defining a pair of inwardly facing channels along respective sides and a web attached to and extending between said channels, and further having a hole through said web intermediate said channels; and a wedge having sides converging towards one end for being conformably received in said C-member between said channels, said wedge having flat opposing surfaces and concave, outwardly facing surfaces on each side, said wedge further having a pin slidably extending through said wedge intermediate said sides, said pin adapted to be pushed into said hole in said web in said C-member after said wedge is pressed into said C-member to secure said wedge against any motion in said C-member.

* * * * *

UNITED STATES PATENT AND TRADEMARK OFFICE

CERTIFICATE OF CORRECTION

PATENT NO. : 5,006,081

DATED : April 9, 1991

INVENTOR(S) : Eugene F. Counsel et al.

It is certified that error appears in the above-identified patent and that said Letters Patent is hereby corrected as shown below:

Claim 3, column 4, line 13 - delete the word "wire" and insert --wires--.

Claim 3, column 4, line 15 - delete the word "edged" and insert --edges--.

Claim 3, column 4, line 20 - delete the word "towards" and insert --toward--.

Signed and Sealed this

Twenty-third Day of February, 1993

*Attest:*

STEPHEN G. KUNIN

*Attesting Officer*

*Acting Commissioner of Patents and Trademarks*